US010485074B2

(12) United States Patent
Mason et al.

(10) Patent No.: US 10,485,074 B2
(45) Date of Patent: Nov. 19, 2019

(54) CONTROLLING LIGHTING DYNAMICS

(71) Applicant: SIGNIFY HOLDING B.V., Eindhoven (NL)

(72) Inventors: Jonathan Davide Mason, Waalre (NL); Dzmitry Viktorovich Aliakseyeu, Eindhoven (NL); Sanae Chraibi, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 149 days.

(21) Appl. No.: 15/529,280

(22) PCT Filed: Oct. 29, 2015

(86) PCT No.: PCT/EP2015/075055
§ 371 (c)(1),
(2) Date: May 24, 2017

(87) PCT Pub. No.: WO2016/083066
PCT Pub. Date: Jun. 2, 2016

(65) Prior Publication Data

US 2017/0265269 A1 Sep. 14, 2017

(30) Foreign Application Priority Data

Nov. 24, 2014 (EP) ..... 14194427

(51) Int. Cl.
*H05B 37/02* (2006.01)
*G09G 3/34* (2006.01)
*H05B 33/08* (2006.01)

(52) U.S. Cl.
CPC ..... *H05B 37/02* (2013.01); *G09G 3/3413* (2013.01); *H05B 33/08* (2013.01); *H05B 37/029* (2013.01);
(Continued)

(58) Field of Classification Search
CPC .... H05B 37/02; H05B 33/08; H05B 37/0272; H05B 37/029; H05B 33/0863;
(Continued)

(56) References Cited

U.S. PATENT DOCUMENTS 9,585,226 B2 * 2/2017 Gajurel ..... H05B 37/02

FOREIGN PATENT DOCUMENTS

EP 2120512 A1 11/2009
WO 02101702 A2 12/2002
(Continued)

OTHER PUBLICATIONS

Matthias Bues et al: "Mediendienst, Den Himmel Ins Büro Holen," http:/www.fraunhofer.de/content/dam/zv/de/presse-medien/2012/pdf/md01_2012_januar.pdf , 2012 (4 Pages).
(Continued)

*Primary Examiner* — Tony Ko
(74) *Attorney, Agent, or Firm* — Meenakshy Chakravorty

(57) ABSTRACT

A lighting system comprising multiple illumination sources is operable to vary a first and second light attribute over an array of locations. A user selects a first layer comprising an image having different values of the first attribute at different positions within the image, and at least one further layer representing motion. The first attribute at different locations in the array is mapped to the values of the first attribute at different positions in the first layer image, and the second attribute is varied based on the further layer so as to create an appearance of motion. The further layer comprises an algorithm selected by the user from amongst a plurality of predetermined algorithms, each configured so as to create the appearance of motion of a plurality of discrete, virtual lighting objects across the array, the motion of each of the virtual lighting objects being related but not coincident.

11 Claims, 4 Drawing Sheets

(52) U.S. Cl.
CPC . *H05B 37/0272* (2013.01); *G09G 2320/0233* (2013.01); *G09G 2320/0646* (2013.01); *G09G 2320/0666* (2013.01); *G09G 2320/106* (2013.01); *G09G 2360/04* (2013.01); *G09G 2360/10* (2013.01); *H05B 33/0863* (2013.01)

(58) Field of Classification Search
CPC ..... G09G 3/3413; G09G 2360/04; G09G 2320/0646; G09G 2360/10; G09G 2320/0666; G09G 2320/0233; G09G 2320/106
See application file for complete search history.

(56) References Cited

FOREIGN PATENT DOCUMENTS

| | | | |
|---|---|---|---|
| WO | 2010061334 | A1 | 6/2010 |
| WO | 2011124933 | A1 | 10/2011 |
| WO | 2013132416 | A1 | 9/2013 |

OTHER PUBLICATIONS

Anonymous: "Lightjames—DMX Lighting Controller Software," http://web.archive.org/web/20141027170115/http://www.lightjames.com 2015 (3 Pages).

* cited by examiner

CONTROLLING LIGHTING DYNAMICS

CROSS-REFERENCE TO PRIOR APPLICATIONS

This application is the U.S. National Phase application under 35 U.S.C. § 371 of International Application No. PCT/EP2015/075055, filed on Oct. 29, 2015, which claims the benefit of European Patent Application No. 14194427.2, filed on Nov. 24, 2014. These applications are hereby incorporated by reference herein.

TECHNICAL FIELD

The present disclosure relates to the control of dynamic effects in a lighting system comprising a plurality of illumination sources for illuminating a scene.

BACKGROUND

"Connected lighting" refers to lighting systems in which illumination sources are controlled not by a traditional, manually-operated mechanical switch between the mains and each illumination sources (or not only by such a switch), but by a means of a more intelligent controller which connects to the luminaires of the system either via a direct wireless data connection with each luminaire (e.g. via ZigBee) or via a wired or wireless data network (e.g. via a Wi-Fi network, 3GPP network or Ethernet network). For instance the controller may take the form of an application running on a user terminal such as a smartphone, tablet, or laptop or desktop computer.

Currently, such systems enable users to set static light scenes that may comprise white light, colored light, or both. In order to allow such scenes to be created, the controller must present the user with a suitable set of controls or user interface. In one example, the controller enables the user to select an illumination source or group of such sources, and to manually input one or more parameters of the light to be emitted by that illumination source or group, e.g. to set a numerical value for the overall intensity of the emitted light and/or to set individual numerical values for the red, green and blue (RGB) components of the light. However, inputting numerical values in this manner is not very user friendly. In another, more user-friendly example, the controller presents the user with a picture such as a photograph, e.g. one selected by the user, and enables the user to select a point in the photograph from which to pick a color, e.g. by dragging and dropping a lamp icon onto the picture. The controller then sets the light output of the scene so as to correspond to the color at the selected point in the picture. Using such methods a static scene can be easily created.

Some connected lighting systems may also include a dynamics engine to allow users to create dynamic lighting scenes as well, i.e. scenes in which the emitted light varies with time. Dynamic lighting is becoming increasingly popular, both for applications in the home and in professional domains such as the office, hospitality and retail.

However, creating dynamic lighting is not a straightforward task for non-professional users (i.e. users who are not professional lighting engineers). Many current systems are limited in terms of how users are required to assign light transitions, and how best to distribute the effects over multiple lamps. Existing methods of accepting a user input to create a dynamic lighting effect rely on the metaphor of a timeline on which the user can define effects that then play out. These often repeat and, if there are multiple lamps, the user must assign a sequence or design to multiple time lines, one for each of the different lamps. This is can be a time consuming process that does not always result in pleasing dynamics. Some mobile applications control dynamics by applying a random color generator, or by allowing the user to drag-and-drop a color picker over video content. However, the results are still often displeasing and/or repetitive.

WO2008/041182 describes a technique for creating non-repetitive natural effects based dynamic lighting. The effect is created by analyzing a picture or a video and then modelling the light effect by applying a hidden Markov chain. Nonetheless, the question of how an end-user can create such scenes is not addressed.

SUMMARY

It would be desirable to provide a method by which a non-professional end-user, unskilled in lighting, can define a dynamic lighting scene of his or her own in a user-friendly manner. Setting a dynamic scene is more complex than a static one, as the light output of each illumination source will vary over time. Another issue is how to map the dynamics over a set of illumination sources so that they do not simply all turn on and off in unison. That is, the manner in which the emitted light varies should preferably be different for the illumination sources at different locations (i.e. the emitted light is a function of both time and luminaire location). As mentioned, one known idea uses video content to provide the color and the motion for the light, but with this direct translation the user must still find a video that contains both the colors and the motion that he or she likes, which may take a great deal of searching or may not even be possible at all.

This present disclosure provides a user-friendly layered approach for commissioning lighting dynamics over multiple illumination sources. The disclosed approach divides dynamic lighting into layers—at least one image layer and at least one algorithm layer—which can each be individually selected by a user, and which are then combined to form the resulting dynamic lighting. This separation helps to make dynamic lighting easier for the user to understand and set up, and enables effects to be created that may not necessarily exist in a single video (or which may not be easy to find in a single video).

According to one aspect disclosed herein, there is provided a method of controlling a lighting system comprising a plurality of illumination sources arranged to emit light for illuminating a scene, the lighting system being operable to vary at least a first and a second attribute of the light at each location of an array of locations over at least two spatial dimensions of the scene. The method comprises: receiving a user selection from a user, to select a first layer comprising an image having different values of the first attribute at different positions within the image; mapping the values of the first attribute from different positions in the first layer image to the values of the first attribute at corresponding locations of said array of locations; receiving a second user selection from the user, to select at least one further layer representing motion; and varying the second attribute of the light based on the at least one further layer so as to create an appearance of motion across the array. The at least one further layer comprises one or more algorithm layers each comprising an algorithm selected by the user from amongst a plurality of predetermined algorithms, each of these algorithms being configured so as when used to vary the second attribute to create the appearance of motion of a plurality of discrete, virtual lighting objects across the array, the motion of each of the virtual lighting objects being related but not coincident.

Thus the first layer is combined with the at least one further layer in order to create a dynamic lighting effect across the scene. In embodiments the first attribute is color, the first layer image being a color image. In embodiments the second attribute is intensity. In such embodiments the virtual lighting objects may each act as a color picker moving across the first layer image, such that the color of the object at its current location takes the color of the first layer image at that location (the intensity of the light at that location is turned on or dimmed up, with the corresponding color, while the light at the other locations in the array is turned off or dimmed down).

The first layer image may be a still image, or alternatively it could be a video image.

In particular embodiments, the algorithm selected by the user (and in embodiments each of the predetermined algorithms) may be a behavioral algorithm whereby the motion of each of the virtual lighting objects models a respective one of a plurality of living creatures, or other self-locomotive objects or objects created or affected by one or more natural phenomenon; and the motion of the virtual lighting objects models the relative behavior of said living creatures, self-locomotive objects or natural phenomenon. In embodiments the motion models living creatures of the same species, e.g. the modelled behavior may be a flocking or swarming behavior of a species such as a species of bird, fish, bees, herd animals or the like. Other examples would be that the motion models motion of jet fighters, passenger planes, hot air balloon, kites, or planets.

It is also possible to use additional layers such as an external influencer layer modelling effects such as such as weather elements, or even a user interaction layer which if the user were to touch the screen this would put in a one-time water ripple or whoosh of wind for that moment. Another possibility is multiple behavior layers that can then interact and influence one other, for example a layer of sardines swim together in formation, then a dolphin layer can come in periodically to startle and scatter the sardines.

Hence in embodiments the at least one further layer may comprise a plurality of algorithm layers, one of which comprises said selected behavioral algorithm, and at least one other of which comprises one of:

(i) an influence algorithm which models an influence of a natural phenomenon or user input on the creatures or objects modelled by said selected behavioral algorithm; or (ii) another behavioral algorithm configured to so as when used to vary the second attribute to create the appearance of motion of one or more further virtual lighting objects across the array, whereby the motion of each of the one or more further virtual lighting objects models a living creature or other self-locomotive object or object created or affected by one or more natural phenomenon, of a different type of creature or object than said one of the algorithm layers, wherein the algorithm layers interact such that the motion of said plurality of virtual lighting objects and said one or more further virtual lighting objects models an interaction between the creatures or objects modelled by said one of the algorithm layers and the creatures or objects modelled by said other of the algorithm layers. In embodiments, said other of the algorithm layers may also be selected by the user.

In further embodiments the first layer image may be a still image, and preferably a color image; while the at least one further layer may comprise a second layer comprising a video image, and a third layer comprising said algorithm. The video image may be selected from a different file than the first layer image (i.e. the first layer image is not taken from any frame of the video image). Thus the first layer, second layer and third layer are combined to create a dynamic lighting effect across the scene. This advantageously divides dynamic lighting into color, motion and behavior layers.

Alternatively the dynamic lighting may be created based on only two layers, e.g. a still image as a first layer and a behavioral algorithm as a further layer, or a video image as the first layer and a behavioral algorithm as a second layer. Or in other alternatives, the lighting could even be created by combining more than three layers.

In yet further embodiments, the method further comprises receiving an indication of a location of one or more human occupants, wherein at least the selected algorithm (and in embodiments each of the predetermined algorithms) is configured such that the motion of the virtual lighting objects will avoid or be attracted to the location of the human occupants based on said indication. E.g. the virtual lighting objects may avoid people or some people by predetermined distance.

According to another aspect disclosed herein, there is provided a computer program embodied on one or more computer-readable storage media and configured so as when run on one or more processors (e.g. of a user terminal) to perform a method in accordance with any of the embodiments disclosed herein.

According to another aspect disclosed herein, there is provided a user terminal (such as a smartphone, tablet or laptop or desktop computer) configured to perform a method in accordance with any of the embodiments disclosed herein.

According to yet another aspect disclosed herein, there is provided a system comprising: a lighting system comprising a plurality of illumination sources arranged to emit light for illuminating a scene, the lighting system being operable to vary at least a first and a second attribute of the light at each location of an array of locations over at least two spatial dimensions of the scene; and a user terminal configured to receive a user selection from a user, the user selecting a first layer comprising an image having different values of the first attribute at different positions within the image; map the values of the first attribute at the different positions in the first layer image to the values of the first attribute at corresponding locations of said array of locations; receive a second user selection from the user, the user selecting at least one further layer representing motion; and vary the second attribute of the light based on the at least one further layer so as to create an appearance of motion across the array; wherein the at least one further layer comprises one or more algorithm layers, each comprising an algorithm selected by the user from amongst a plurality of predetermined algorithms, each of the algorithms being configured to so as when used to vary the second attribute to create the appearance of motion of a plurality of discrete, virtual lighting objects across the array, the motion of each of the virtual lighting objects being related but not coincident. In embodiments, the user terminal may be configured to perform further operations in accordance with any of the embodiments disclosed herein.

BRIEF DESCRIPTION OF THE DRAWINGS

To assist understanding of the present disclosure and to show how embodiments may be put into effect, reference is made by way of example to the accompanying drawings in which.

DETAILED DESCRIPTION OF EMBODIMENTS

Figure 1:
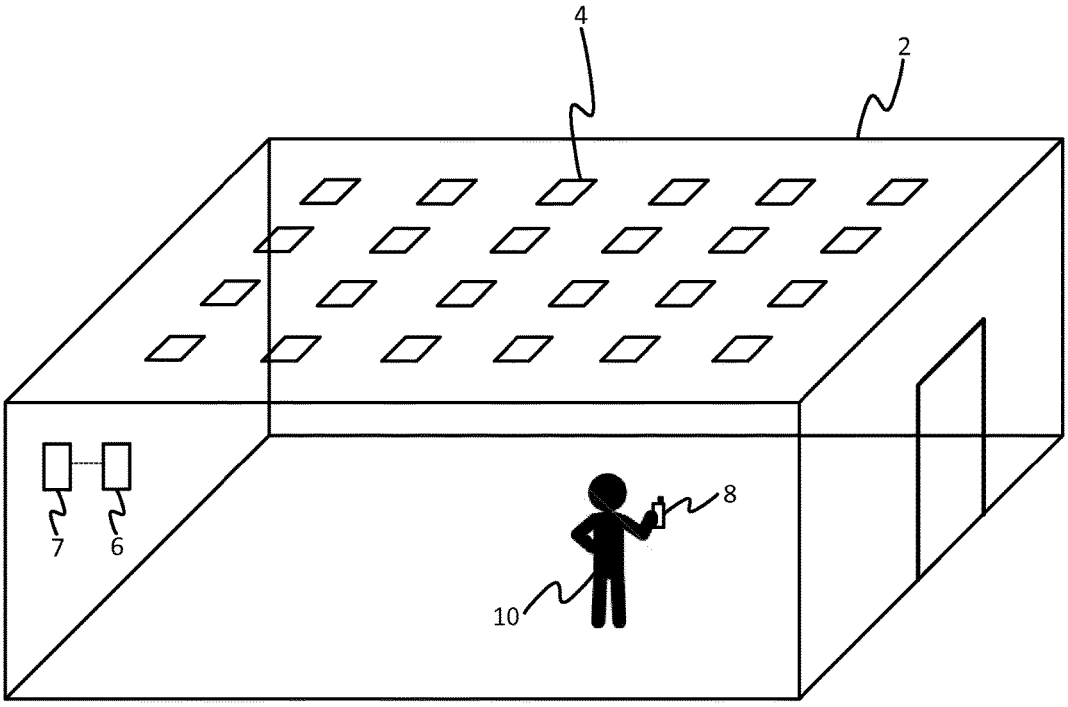
FIG. 1 is a schematic representation of a space comprising a lighting system.

FIG. 1 illustrates an example lighting system in accordance with embodiments disclosed herein. The lighting system comprises a plurality of luminaires 4 disposed at different respective locations throughout an environment 2. For example the environment 2 may comprise in indoor space such as the interior of a room or concert hall, or an outdoor space such as a park, or a partially covered space such as a stadium. Each of the luminaires 4 is a different physical device comprising a respective one or more lamps (i.e. one or more illumination sources). Each of these luminaires 4 may be fixedly installed at its respective location, or may be a free-standing unit. The luminaires 4 are arranged so as together to illuminate a scene within the environment 2, thereby creating a lighting scene. By way of example the luminaires 4 are show arranged in a regular rectangular grid, but in other embodiments other shaped arrangements are possible and/or the array need not be regular. Note also that each of the terms "luminaire", "lamp" or "illumination source" refers specifically to a device which emits not just any light, but specifically illumination, i.e. light on a scale suitable for contributing to the illuminating of an environment 2 occupied by humans (so that the human occupants can see within the environment 2, and optionally also to create a lighting atmosphere within the environment 2). A luminaire 4 is a device comprising one or more lamps (i.e. illumination sources) plus associated socket, housing and/or support. A lamp or illumination source may take any of a number of different possible forms such as an LED-based illumination source (comprising one or more LEDs), traditional incandescent bulbs, gas-discharge lamps (e.g. fluorescent tubes), etc. Further, a luminaire 4 may take various forms such as a traditional ceiling or wall mounted room lighting, or a floor-standing or table-standing unit, or a less traditional form such as an LED-strip embedded in a wall or furniture.

Each of the luminaires 4 is a connected luminaire in that it comprises a receiver configured to receive data from a user terminal 8 for controlling the luminaire 4, and optionally may also comprise a transmitter configured to transmit data back to the user terminal 8 such as for providing acknowledgements or status updates. The user terminal 8 comprises a corresponding transmitter and optionally receiver respectively. For example, the user terminal 8 may take the form of a mobile user terminal such as a smartphone, tablet or laptop; or a static user terminal such as a desktop computer. The user terminal 8 is installed with a lighting control application which is configured so as when run on the user terminal 8 to use one or more transmitters of the user terminal 8 to send data in the form of lighting control commands to each of the luminaires 4 in order to individually control the light that each emits, e.g. to switch the light on and off, dim the light level up and down, and/or to adjust the color of the emitted light. The lighting control application may optionally also use the receiver of the user terminal 8 to receive data in the other direction from the luminaires 4, e.g. to receive an acknowledgement in response to a control command, or a response to a control command that requested a status update rather than controlling the emitted light.

This communication between the application on the user terminal 8 and each of the luminaires 4 may be implemented in a number of ways. Note that the transmission from user terminal 8 to luminaire 4 may or may not be implemented in the same way as any transmission from luminaire 4 to user terminal 8. Note also that the communication may or may not be implemented in the same way for the different luminaires 4. Further, the communications may be implemented wirelessly or over a wired connection, or a combination of the two. Some examples are set out below, each of which may in embodiments be used to implement any of the communications discussed herein. In each case the user terminal 8 may be described as communicating with the luminaires 4 via a wireless and/or wired network, either formed by or comprising the user terminal 8 and luminaires 4.

In some embodiments, the user terminal 8 is configured to communicate directly with each of one or more of the luminaires 4, i.e. without communicating via an intermediate node. For example, the user terminal 8 may be a wireless terminal configured to communicate directly with each of the luminaires 4 via a wireless channel, e.g. a ZigBee channel, thus forming a wireless network directly between the user terminal 8 and luminaires 4. In another example, the user terminal 8 may be configured to communicate directly with the luminaires over a wired network, such as a DMX network if the user terminal 8 is itself a DMX controller.

Alternatively or additionally, the user terminal 8 may be configured to communicate with each of one or more of the luminaires 4 via at least one intermediate node in the form of at least one bridge, gateway, hub, proxy or router 6. For example, the user terminal 8 may be a wireless terminal configured to communicate with such luminaires 4 via a wireless router, e.g. a Wi-Fi router, thus communicating via a wireless network such as a Wi-Fi network comprising the wireless router 6, user terminal 8 and luminaires 4. As another example, the intermediate node 6 may comprise a wired router such as an Ethernet router, the user terminal 8 being configured to communicate with the luminaires 4 via a wired network such as an Ethernet network comprising the wired router, user terminal 8 and luminaires 4. In yet another example, the intermediate node 6 may be a DMX proxy.

In further alternative or additional embodiments, the user terminal 8 may be configured to communicate with each of one or more of the luminaires 4 via an intermediate node in the form of a centralized lighting control unit 7. Such communication may or may not occur via a router 6 or the like, e.g. Wi-Fi router (and the connection between the control unit 7 and router 6 may be wired or wireless). Either way, the control unit 7 receives control commands from the user terminal 8, and forwards them to the relevant one or more luminaires 4 to which the commands are directed. The control unit 7 may be configured with additional control functionality, such as to authenticate whether the user terminal 8 and/or its user 10 is/are entitled to control the lights 4, and/or to arbitrate between potentially conflicting commands from multiple users. Note therefore that the term command as used herein does not necessarily imply that the command is acted on unconditionally (though that is not excluded either). Note also that in embodiments, the commands may be forwarded to the destination luminaire 4 in a different format than received from the user terminal 8 (so the idea of a sending a command from user terminal 8 to luminaire 4 refers herein to sending the substantive content or meaning of the command, not its particular format or protocol).

Thus by one or more of the above means, the user terminal 8 is provided with the ability to communicate with the luminaires 4 in order to control them remotely, including at least to control the light they emit. It will be appreciated that the scope of the disclosure is not limited to any particular means of communication.

By whatever means the communication is implemented, the lighting control application on the user terminal 8 must present the user 10 of that terminal with a suitable interface, for selecting the manner in which the user 10 desires that the light emitted by the luminaires 4 is controlled.

However, as discussed above, creating dynamic lighting is not a simple task for a non-professional. For example, existing methods rely on the metaphor of timelines on which the user can add effects that then play out, but these often repeat and if there are multiple luminaires then the user must assign a sequence or design multiple timelines for different ones of the luminaires. This can be a time consuming process that does not always results in pleasing dynamics. WO2008/041182 describes a technique for creating non-repetitive natural effects by analyzing a picture or video and then applying a hidden Markov chain, but it does not disclose how a non-professional end-user can create such scenes. Therefore it would be desirable to provide an improved method for setting dynamic light scenes.

The present disclosure provides a layered set up for generating lighting dynamics in lighting systems such as that of FIG. 1. In embodiments, this provides the end user with a means of defining their own dynamic lighting settings that are non-repetitive, unique and map easily over multiple lamps.

Figure 2:
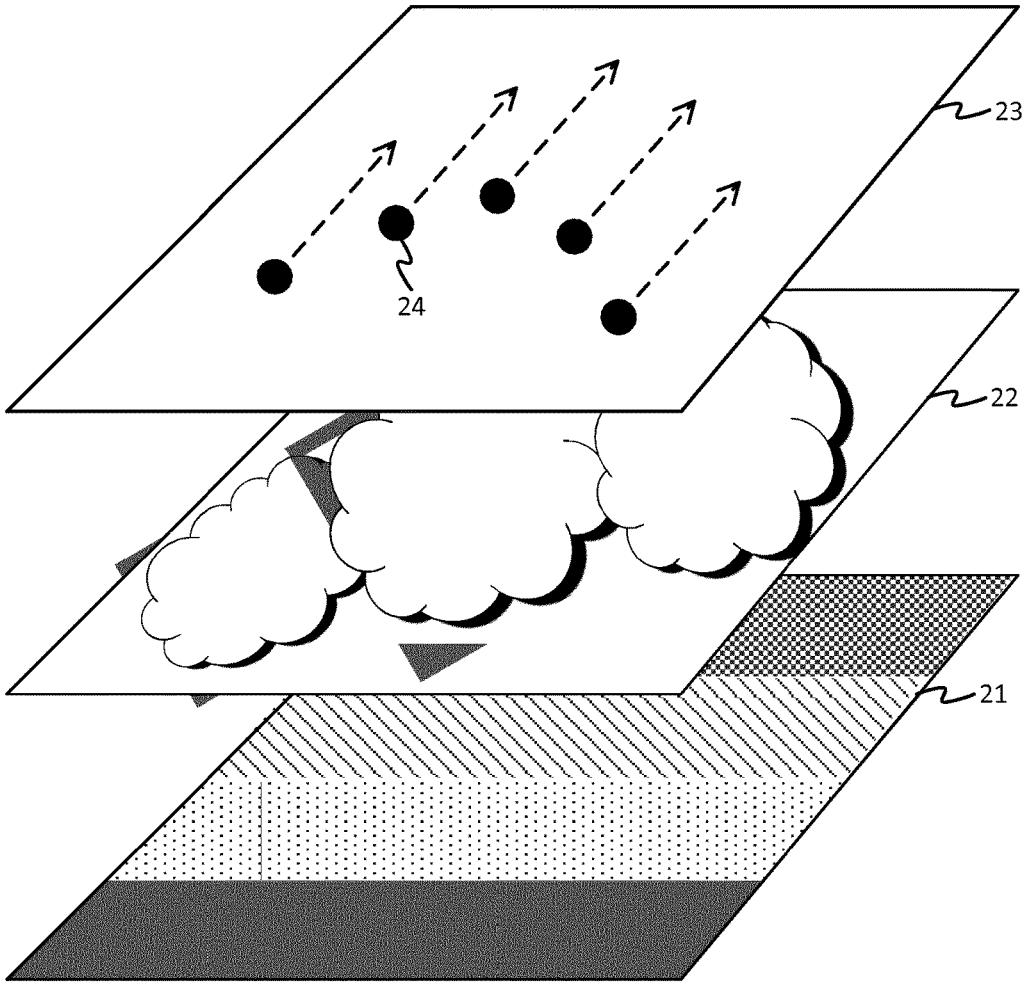
FIG. 2 is a schematic illustration of a plurality of layers.
Figure 3A:
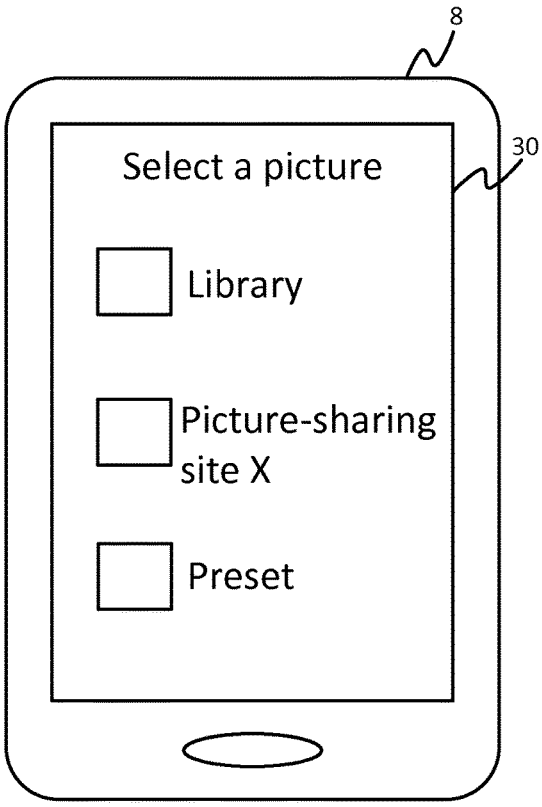
FIGS. 3*a-d* are a schematic illustration of a user interface.
Figure 3B:
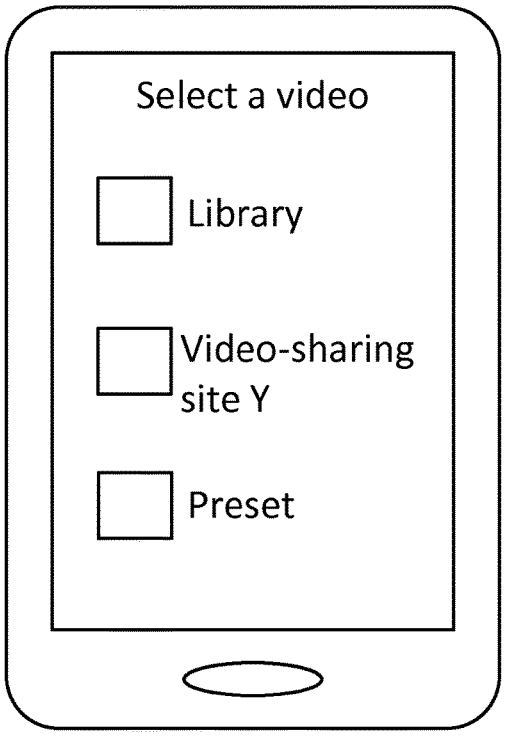
Figure 3C:
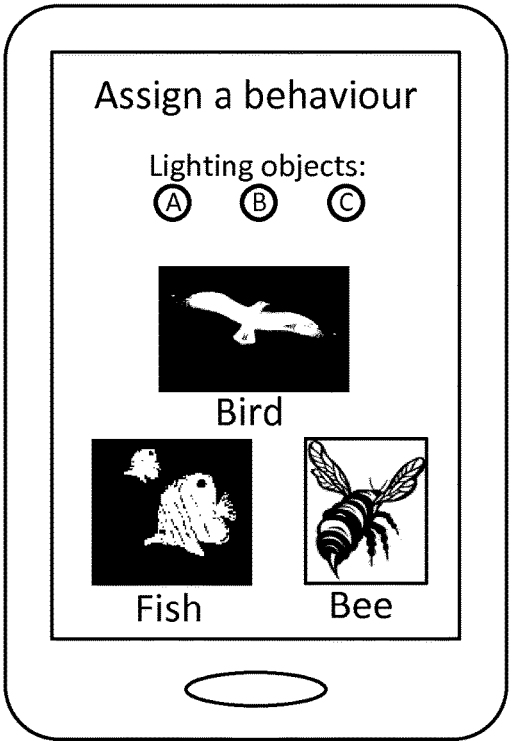
Figure 3D:
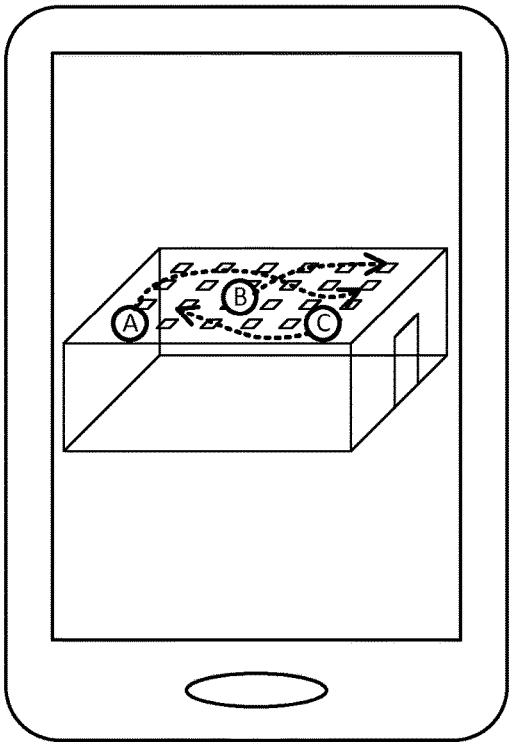

FIG. 2 illustrates the concept of the layered approach to creating lighting dynamics in accordance with embodiments of the present disclosure, and FIGS. 3*a*-3*d* show an example of a corresponding user interface 30 as presented by the lighting control application running on the user terminal 8.

The user interface 30 presents the user 10 with controls for selecting each of a plurality of "layers" 21, 22, 23, each from amongst a plurality of predetermined options for that layer. The layers comprise at least one image layer 21, 22 and at least one algorithm layer 23. Each of the image layers 21, 22 may be a still image or a video image depending on implementation. The algorithm layer defines the paths of a plurality of "virtual lighting objects" 24. The lighting control application on the user terminal 8 then combines the layers on top of one other in order to create a combined lighting effect which it plays out through the array of luminaires 4 (e.g. using any of the above channels for sending lighting control commands).

In embodiments, the definition of the dynamic scene is split into two or three distinct layers, as follows.

(i) As a first layer 21, a static picture is selected to define the colors to be used in the light scene (ii) As a second (optional) layer 22, a video is selected to provide an essence of the dynamic. For example the video can define how the colors from the first layer are selected, such as to define the intensity with which the colors are selected. In some situations or embodiments this layer can be skipped or omitted.

(iii) As a third layer, an algorithm is selected to define motion behavior of each of the virtual lighting objects 24 across the picture (defined by the first layer 21). Motion behavior can be defined using nature based algorithms, e.g. modelling the movement of flock of birds where each virtual lighting object 24 is assigned to a respective one of the birds. All of the virtual lighting objects 24 can have similar movement behaviors or different behavior based on user's input.

In embodiments, each layer 21, 22, 23 can be selected independently, i.e. so the choice of one does not affect the choice of the other. E.g. the choice of still image at the first layer 21 does not limit the set of available video images at the second layer 22, nor the set of available algorithms at the third layer 23. Though in some embodiments, the selection of the second layer 22 (video selection) may be limited by the capabilities of the system—e.g. the lighting control application may limit the choice by the user or may even select a video itself, to ensure the video is slow enough to be played out given the reaction time of the luminaires 4.

The interaction of these three layers 21, 22, 23 will define unique dynamic lighting. A more detailed description of such layers and how they can be defined by user are described below.

The user interface 30 and user interaction can be implemented in a number of different ways, but an example is given in FIGS. 3(*a*)-(*d*). These show a user-friendly user interface 30 implemented by the lighting control application through a touch-screen of the user terminal 8. According to this user interface 30, the user first selects a picture then the video, and then finally assigns the behaviors of the virtual lighting objects 24.

FIG. 3(*a*) shows a first screen of the user interface 30 in which the user 10 is presented with the options of selecting a picture from a local library (from local storage of the user terminal 8), or selecting a picture from the Internet or a particular picture sharing site on the Internet, or taking a picture using a camera of the user terminal 8. Whichever picture the user selects from whichever source is set as the first layer image 21.

FIG. 3(*b*) shows a second screen of the user interface 30 in which, after the picture is selected, the user 10 is presented with the options of selecting a video from a local library (from local storage of the user terminal 8), or selecting a video from the Internet or a particular video sharing site on the Internet, or capturing a video using a camera of the user terminal 8. Whichever video the user selects from whichever source is set as the second layer image 22.

FIG. 3(*c*) shows a third screen of the user interface 30 in which, after the picture and video are selected, the user 10 is present with options for assigning a motion behavior of the virtual lighting objects 24, for example selecting from amongst animal, bird, fish and/or insect motion patterns. In the illustrated example, the user 10 is given the ability to drag and drop a lamp icon (A, B, C) for each of the virtual lighting objects 24 onto one of a set of icons each representing a respective behavior, but this is just one example. In another example, the user may select a behavior to apply collectively to all of the virtual lighting objects 24, for example selecting a swarming or flocking algorithm in which all of the virtual lighting objects 24 are modelled as creatures of the same species (e.g. a swarm of bees, school of fish or flock of birds).

FIG. 3(*d*) shows a fourth screen of the user interface 30. Here, when the dynamic lighting is operational, the application shows the current location of each virtual lighting object 24 (A, B, C) within the scene or environment 2. It may also show the movement trace, i.e. where each virtual lighting object 24 has been and/or where it is moving to. In some embodiments, on this screen the user 10 may also be given the ability to alter the path by dragging a virtual lighting object 24 to a different location.

The two or three key layers 21, 22, 23 work together to provide a dynamic light output.

In embodiments, the first layer 21 is the color layer. This provides the color, and may for example be a photograph or other still, color image that the user 10 likes. E.g. it may be a photograph taken at that moment or one taken previously, or found on the Internet, etc.

To apply the selected color layer 21, the lighting control application maps the luminaires 4 at the different locations within the environment 2 to the colors at respective corresponding positions in the selected image 21, e.g. mapping the image to a plan view of the environment 2. Thus the color scheme across the lighting array 4 reflects the colors of the selected image 21. Though note that the array of luminaires 4 does not necessarily have to be dense enough to see the emitted colors as an image—it is the overall color effect that is reflected by the lighting. E.g. if the image is of a sunset and the environment 2 is an arena, the color mapped to the lighting 4 on one side of the area may be red, gradually changing to orange, then yellow, then blue across the arena.

In embodiments, the second layer 22 is the motion layer. This is a video in which the motion of the video content is used to inform the algorithm of the type of motion that the user likes (see more detail below). The video can be from the internet or recorded by the end user 10. Only the motion is taken into account here and not the color of the video. The video processing algorithms can detect the motion from the particular content of the video, e.g. a car moving past or a bird flying, or it can detect the general motion such as the person moving the camera around.

The third layer 23 is the behavior layer. For this layer, the user 10 assigns the virtual lighting objects 24 to behavior types that will move over the aforementioned color and motion layers 21, 22. The virtual lighting objects 24 are points or discrete "blobs" of light that appear to move over the array of actual, physical luminaires 4, this effect being created by controlling the intensities of the luminaires 4 at different locations, i.e. by turning them on or off or dimming them up or down. Each virtual lighting object 24 is in effect a color picker which moves around automatically over the underlying image layer 21 to control the color of the luminaires 4 at the corresponding location in the environment 2. I.e. when each of the virtual lighting objects 24 is at a respective set of coordinates—e.g. corresponding to respective luminaires 4 at coordinates (xA, yA) (xB, yB) and (xC, yC) in the lighting array—then the algorithm controls the luminaire 4 at each of those coordinates to turn on and emit with the respective color mapped to the respective coordinates by the color layer (first layer) 21, while each of the other luminaires 4 in the array are turned off. Or alternatively, the algorithm may control the luminaire 4 at each of the coordinates of the virtual lighting objects 24 to dim up to a higher intensity (e.g. 80% or 100% of maximum) while each of the other luminaires 4 in the array are dimmed down to a lower intensity (e.g. 20% of maximum), each emitting its light with the respective color mapped to the respective coordinates by the color layer (first layer) 21. Thus the luminaires 4 are controlled according to a plurality of color pickers 24 traveling over an image 21.

The movements of the color pickers 24 are related but not equal. In embodiments, the way the color picker 24 moves around is determined by a 'natural' algorithm, such as a synthesized flight pattern of a bird or the movements a turtle would make. There are multiple color pickers 24 each implementing a respective one of the virtual lighting objects 24. These multiple color pickers 24 behave in a related way (though not necessarily synchronized), such as the way a flock of birds or a turtle with baby turtles would move.

For example, each virtual lighting device 24 at the algorithm layer 23 may be assigned to a bird and the flocking behavior of these birds, modelled based on known flocking algorithms, will cause them 'fly' over the color and motion layers 21, 22. Whichever part of the color and motion layer 21, 22 the "light-bird" 24 is over, the algorithm will compute an output based on the color and the stochastic motion of the video. In embodiments this combination will ensure an infinite (or effectively infinite) variety of dynamic output that will never repeat.

A variety of flocking or swarming algorithms are possible, and other examples can be assigned to the virtual lighting objects 24, such as algorithms modelling schools of fish, algorithms modelling different bird types in combination (e.g. an eagle with smaller birds), herding algorithms modelling sheep or other herd animals, or circulation algorithms modelling humans. In some embodiments the system could include multiple behavior layers such as birds and fish, and these may influence each other, e.g. the fish may be frightened by the birds.

Living creatures are one form of metaphorical means of helping the user understand the type of motion the algorithm may offer. In other embodiments, the system may equally offer an algorithm modelling the motion of, for example, aeroplanes such as jet fighters or passenger planes, hot air balloons, and/or kites, as these too may provide sufficient understanding for the user.

Some embodiments may also use additional layers such as an external influencer layer modelling factors such as weather elements, or even a user interaction layer which if the user were to touch the screen this would put in a one-time water ripple or whoosh of wind for that moment. Any such layers may also be selected by the user.

Alternatively or additionally, the user may select multiple behavior layers that can then interact and therefore influence one another. For example a layer of sardines swim together in formation, then a dolphin layer can come in periodically to startle and scatter the sardines.

Also, the virtual lighting objects may or may not be clustered together in the same flock (or the like). If they are in the same flock, then the dynamic will be more even across much of the physical space as they are likely to be moving around in close proximity over the image layer. If they are more distributed, e.g. in separate flocks, or one is a predator while the others are prey, then the dynamic will be more excited as at times as they will be over very different parts of the image layer. They will also influence each other resulting in more energetic and then calm moments as they move towards or away from each other.

FIG. 2 shows examples of the different layers. At the top layer 23 are flocking "bird lamps" 24, and under these other objects 24 could also be assigned to algorithms modelling other behavior, e.g. fish-like swarm algorithms. These determine where the virtual lighting objects 24 will "look" for the dynamic signals on the layers 21, 22 below.

The next layer down 22 in FIG. 2 is the black and white motion layer (even if a color video is selected the colors are ignored by the algorithm, i.e. only the monochromatic intensities are used). The lighting application uses a stochastic like algorithm for analyzing the video 22 and learning the motion that is in it. In embodiments, this may be applied selectively to spatial and/or temporal segments of the video clip—as some segments will have more motion while others may even have none.

Beneath this is the color layer 21. This is the layer that the user 10 uses to define the general color scheme for his or her dynamic.

The motion of the video content in the video layer 22 is used to inform the algorithm of the type of motion that the user likes In embodiments, the video layer 22 is applied by analyzing the video and then applying a hidden Markov chain, e.g. in accordance with WO2008/041182. The purpose of the Markov is to reduce the chance of repetition in the lighting (though even with a repetitive video for the color, when this is layered with a swarm/flocking behavior layer then the chance of repetition is reduced considerably). The non-repetitiveness is achieved through using randomization in the generated dynamic effect, with the randomization being made dependent on the video 22. An example in the form of a metaphor is where the behavior of an "animal" has some defined and some random aspects these can be well described using Markov chain. A Markov chain is a set of probabilities of changing a state. E.g. if the bird flight straight there is certain probability associated with it to continue straight, but there is also probability for a bird to change it direction (and these probabilities are not arbitrary but can be learned from observing an actual bird).

In some alternative embodiments, the video layer 22 can be omitted, so then only the picture and behavior layers 21, 23 are used. In this case the color of each lighting object 24 will be fully defined by its location on the static picture 21, while the "movement" of the object 24 across the picture will be defined by the chosen behavior algorithm 23.

Alternatively, the video could also replace the picture image, thus the behavior layer moves around over the moving video image.

In embodiments, the effect of the video layer 22 may depend on the detail of the behavior algorithm 23. If the behavior algorithm just define the location of the virtual objects 24 on the image 21, then this in itself may define the color to be rendered without a vide layer 22. Alternatively, as discussed above, it is also possible to combine this with a dynamic from the video 22 so rather than rendering a static color when the flock moves over the lamp, the lamp could for example flicker in akin to a selected video (this is an example of where the Markov chain comes in to translate video to light output for each color in real time).

In yet further alternative embodiments, other combinations of behavior layer and one or more image layers 21, 22 are possible, e.g. a behavior layer 23 may be applied over a single color video layer, or a monochromatic image may be used as the only underlying image layer to define varying intensities but not colors of the lighting objects 24 as they move about.

Note that connected lighting ecosystems are often heterogeneous, i.e. consist of luminaires 4 with different capabilities, and moreover such systems have different limitations on how quickly they can render different colors, e.g. some systems may not be able to render very rapid changes in color. In embodiments, the layered approach disclosed herein allows such limitations to be seamlessly integrated, so that user 10 does not have to address them manually or feel limited in how to set the dynamics. Such integration can be achieved in at least two different ways. One way is to only allow the user 10 to control two layers: picture 21 and behavior 23, while the intermediate layer 22 (video driven dynamics) is invisible to the user 10 and defined by the capabilities of the system. In this case the lighting control application itself choses a video that for example is slow enough for the reaction time of lamps. Alternatively, the user 10 may still be given control over all layers 21, 22, 23, but the selection of behaviors available for each lighting object 24 is limited by the capabilities of the lighting system 4. For example if the lighting application offers a bee like behavior where the objects 24 will "move" to the parts of the picture with most saturated colors (i.e. "flowers") then this behavior will only be available to the luminaires 4 that can generate saturated colors and not available to the other luminaires 4.

In further embodiments, the behavioral algorithm may be configured to mix the virtual behavior of the lighting objects 24 with reality. Dynamic lighting in an environment tends to be easily accepted by people when it is in certain places or under certain conditions. For example, when at the theatre or watching a stage performance, people are used to seeing sometimes very bright and strong dynamic lighting in front of them, and when at home people are used to having candle light around that is very soft, etc. However, dynamic lighting is not suitable for all conditions or situations, and it is recognized herein that the dynamics should not tend to be too close to people (e.g. dynamics are not suited for task lighting), or at least when the light is close to people the dynamics should be less intense and/or slower.

To implement such a rule or rules, another layer may be included that represents the people in the environment 2. This may be an invisible behavior layer that uses the location and movement of the real people to influence the virtual flocks and swarms 24. This may be achieved using indoor presence sensing, or any other localization technology for sensing proximity of a person to a virtual lighting object 24. Consequently, a flock/swarm pattern of real people can be calculated and used to direct the virtual flocks/swarms, or even vice versa.

Using such a set up would ensure that the dynamic flocks/swarms are repelled from the luminaires 4 that people are near. The dynamics would thus become less intense near to people and more intense the further away they are. In embodiments, the sensitivity of the virtual flock or swarm's reaction to real people can be adjusted, and even reversed so the dynamics are attracted towards people depending on the behavior type of the layer. For example children may love to be chased by the light, while adults may like to sit in static light but have some dynamics in the distance. In such embodiment the behavior may be modelled by an avoidance spectrum from zero to high. And/or, the algorithm may be configured to identify specific types or groups of people or specific individual people, and adapt the avoidance or attraction behavior in dependence on the person, group or type of person. The people may be identified for example by using image recognition based on one or more cameras in the environment 2, and/or by tracking the IDs of mobile devices carried by the people in the environment 2.

It will be appreciated that the above embodiments have been described only by way of example.

For instance, while in the above the array of lighting locations corresponds to the locations at which the luminaires 4 are installed or disposed, alternatively the array of different possible lighting locations could be achieved by luminaires 4 that are at different locations than the location being illuminated, and even by a different number of luminaires 4 than possible lighting locations in the array. For example, the luminaires 4 could be movable spotlights or luminaires with beam-forming capability whose beam directions can be controlled by the lighting control application. Also, note that the term array as used herein does not imply any particular shape or layout, and that describing the dynamic effects in terms of motion across the array does not necessarily mean the whole way across. Also, while the above has been described in terms of a plurality of lamps distributed over a plurality of luminaires (i.e. separate housings), in embodiments the techniques disclosed herein could be implemented using a plurality of lamps in a given luminaire, e.g. by arranging the lamps to emit their respective illumination at different angles, or arranging lamps at different locations into a large shared housing.

Further, the above method uses a user-selected image to set the colors of the lighting at different positions, then uses a separate user-selected video and/or algorithm to generate a moving effect over the scene. In such embodiments, color may be controlled in a number of ways, such as RGB (red-green-blue) values, color temperature, CRI (color rendering index), or saturation of a specific color while maintaining a general color of illumination. Further, in alternative embodiments, a similar technique could be applied using other light attributes, not just color, i.e. any other light effect controls could be extracted from the one or more image layers 21, e.g. intensity. For instance, the system could use an intensity map layer defined by the selected image instead of a color map, with the position of the virtual lighting objects being represented by point of a certain distinctive color moving over the intensity map.

Further, note that while above the control of the luminaires 4 has been described as being performed by a lighting control application run on a user terminal 8 (i.e. in software), in alternative embodiments it is not excluded that such control functionality could be implemented for example in dedicated hardware circuitry, or a combination of software and dedicated hardware.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfil the functions of several items recited in the claims. The mere fact that certain measures are recited in mutually different dependent claims does not indicate that a combination of these measures cannot be used to advantage. A computer program may be stored and/or distributed on a suitable medium, such as an optical storage medium or a solid-state medium supplied together with or as part of other hardware, but may also be distributed in other forms, such as via the Internet or other wired or wireless telecommunication systems. Any reference signs in the claims should not be construed as limiting the scope.

The invention claimed is:

1. A method of controlling a lighting system comprising a plurality of illumination sources arranged to emit light for illuminating a scene, the lighting system being operable to vary at least color and intensity of the light at each location of an array of locations over at least two spatial dimensions of the scene, and the method comprising:

receiving as a user selection from a user, a static picture having different color values at different positions;

mapping the color values from different positions in the static picture to color values at corresponding locations of said array of locations;

receiving as a second user selection from the user one or more algorithms, representing motion, selected by the user from amongst a plurality of predetermined algorithms; and varying the intensity of the light based on the one or more algorithms so as to create an appearance of motion across the array;

wherein the static picture is combined with the one or more algorithms in order to create a dynamic lighting effect across the scene, wherein each of the algorithms is configured so as when used to vary the intensity in creating the dynamic lighting effect to create the appearance of motion of a plurality of discrete, virtual lighting objects moving across the static picture, such that the virtual lighting objects each act as a color picker moving across the static picture, the motion of each of the virtual lighting objects being related but not coincident.

2. The method of claim 1, wherein the static picture is a still image.

3. The method of claim 1, wherein the algorithm selected by the user is a behavioral algorithm whereby the motion of each of the virtual lighting objects models a respective one of a plurality of living creatures, or other self-locomotive objects or objects created or affected by one or more natural phenomenon; and the motion of the virtual lighting objects models the relative behavior of said living creatures, self-locomotive objects or natural phenomenon.

4. The method of claim 3, wherein each of the predetermined algorithms is a behavioral algorithm whereby the motion of each of the virtual lighting objects models a respective one of a plurality of living creatures or other self-locomotive objects or objects created or affected by one or more natural phenomenon; and the motion of the virtual lighting objects models the relative behavior of said living creatures, self-locomotive objects or natural phenomenon.

5. The method of claim 3, wherein the motion of each of the virtual lighting objects models a respective one of a plurality of living creatures, and the living creatures modelled by the behavioral algorithm are of the same species, the behavior modelled by the behavioral algorithm being a flocking or swarming behavior.

6. The method of claim 5, wherein the user selected one or more algorithms comprises a plurality of algorithms: one of which comprises said selected behavioral algorithm, and at least one other of which comprises one of:

(i) an influence algorithm which models an influence of a natural phenomenon on the creatures or objects modelled by said selected behavioral algorithm; or (ii) another behavioral algorithm configured to so as when used to vary the second attribute to create the appearance of motion of one or more further virtual lighting objects moving across the first layer static picture, whereby the motion of each of the one or more further virtual lighting objects models a living creature or other self-locomotive object or object created or affected by one or more natural phenomenon, of a different type of creature or object than said one of the plurality of algorithms, wherein the plurality of algorithms interact such that the motion of said plurality of virtual lighting objects and said one or more further virtual lighting objects models an interaction between the creatures or objects modelled by said behavioral algorithms and the creatures or objects modelled by said another behavioral algorithm.

7. The method of claim 6, wherein said another behavioral algorithm is also selected by the user.

8. The method of claim 1, further comprising receiving an indication of a location of one or more human occupants, wherein at least one of the selected one or more algorithms is configured such that the motion of the virtual lighting objects will avoid or be attracted to the location of the human occupants based on said indication.

9. A computer program embodied on one or more non-transitory computer-readable storage media and configured so as when run on one or more processors to perform the method of claim 1.

10. A user terminal for controlling a lighting system comprising a plurality of illumination sources, the user terminal is configured to communicate with each of the illumination sources and configured to perform the method of claim 1.

11. A system comprising:

a lighting system comprising a plurality of illumination sources arranged to emit light for illuminating a scene, the lighting system being operable to vary at least color and intensity of the light at each location of an array of locations over at least two spatial dimensions of the scene; and a user terminal configured to receive a user selection from a user, the user selecting a static picture having different color values at different positions; map the color values at the different positions in the static picture to the color values at corresponding locations of said array of locations; receive a second user selection from the user, the user selecting one or more algorithms representing motion selected by the user from amongst a plurality of predetermined algorithms; and vary the intensity of the light based on the one or more algorithms so as to create an appearance of motion across the array;

wherein the static picture is combined with the one or more algorithms in order to create a dynamic lighting effect across the scene;

wherein each of the algorithms is configured so as when used to vary the intensity in creating the dynamic lighting effect to create the appearance of motion of a plurality of discrete, virtual lighting objects moving across the static picture, such that the virtual lighting objects each act as a color picker moving across the static picture, the motion of each of the virtual lighting objects being related but not coincident.

* * * * *